US005341985A

United States Patent [19]

Peterson

[11] Patent Number: 5,341,985

[45] Date of Patent: Aug. 30, 1994

[54] BUSINESS FORM ASSEMBLY WITH INTEGRATED MAILER AND RETURN ENVELOPE

[75] Inventor: Michael A. Peterson, Jerome, Id.

[73] Assignee: Moore Business Forms, Inc., Grand Island, N.Y.

[21] Appl. No.: 5,308

[22] Filed: Jan. 19, 1993

[51] Int. Cl.[5] ..... B65D 27/06

[52] U.S. Cl. ..... 229/305; 229/69; 229/315

[58] Field of Search ..... 229/69, 305, 315

[56] References Cited

U.S. PATENT DOCUMENTS

| | | | |
|---|---|---|---|
| Re. 33,570 | 4/1991 | Ashby . | |
| 1,401,324 | 12/1921 | Dority et al. . | |
| 3,419,286 | 12/1968 | Noonan et al. | 229/69 |
| 3,905,545 | 9/1975 | Juszak et al. | 229/69 |
| 4,081,127 | 3/1978 | Steidinger | 229/69 |
| 4,346,916 | 8/1982 | Shelton . | |
| 4,435,001 | 3/1984 | Mills et al. | 282/11.5 |
| 4,770,337 | 9/1988 | Leibe | 229/69 |
| 4,896,822 | 1/1990 | Ashby . | |
| 4,915,287 | 4/1990 | Volk et al. | 229/70 |
| 5,024,374 | 6/1991 | Ashby . | |
| 5,040,720 | 8/1991 | Pennock . | |
| 5,104,036 | 4/1992 | Rutkowski et al. | 229/301 |
| 5,110,043 | 5/1992 | Ashby . | |
| 5,118,030 | 6/1992 | McNamara et al. . | |

*Primary Examiner*—Stephen P. Garbe
*Attorney, Agent, or Firm*—Nixon & Vanderhye

[57] ABSTRACT

The business form assembly includes an integrated mailer and return envelope comprising first, second, third and fourth plies having first, second, third and fourth edges. The first and third edges of the four plies are adhesively secured one to the other. Additional lines of adhesive are inset from a tear strip containing the adhesive securing the first, second, third and fourth plies to one another for securing the second and third plies to one another. The second and third plies are inset along second and fourth edges to enable adhesive securement of the first and fourth plies along the first and fourth edges to one another. A return envelope flap is formed by a fold line in the third ply. A registering line of perforations in the second ply defines the back face of the return envelope and a record-keeping portion between the line of perforations and the fourth edge. Upon detachment of that record-keeping portion and insertion of it, together with other materials, in the return envelope, the return envelope may be returned to the sender. Thus, the mailer with return inserts may be formed solely of four plies. A fifth ply is used as a fly sheet.

16 Claims, 5 Drawing Sheets

BUSINESS FORM ASSEMBLY WITH INTEGRATED MAILER AND RETURN ENVELOPE

TECHNICAL FIELD

The present invention relates to a continuous business form assembly and more particularly relates to a business form assembly including an integrated mailer and a return envelope with reduced number of plies.

Business form assemblies often include a plurality of plies which register one with the other and form a mailer and a return envelope. Inserts are frequently disposed between the plies for use by the recipient of the mailer. Typically, such business form assembly may include a fly sheet for use in the manufacturing and printing of the assembly including printing on the mailer and return envelope. Conventionally, the plies are fed in a continuous stream with a number of the plies having control margins with paper feed sprocket holes along the sides of the assembly to control the feed through the various manufacturing operations and through the printer where computer generated information is printed on the assembly.

BACKGROUND

While a variety of business form assemblies have been proposed and constructed in the past, they normally take the form of a six part form including a fly sheet, the front and back of sheets or plies of the mailer, the front and back plies or sheets of the return envelope and one or more inserts which are conventionally used by the recipient of the mailer for enclosing, for example, with a check in the return envelope, and for record-keeping purposes by the recipient. Assemblies of this type typically therefore include six or more discreet sheets or webs.

DISCLOSURE OF THE INVENTION

In accordance with the present invention, it has been found that the number of sheets or plies comprising the business form assembly can be reduced. For example, the assembly can be reduced from six plies to five plies if the size of the return envelope is reduced to a minimum mailing size and portions of the sheets or plies which form the back and/or front face of the return envelope can be used as record-keeping stubs. Thus, in the present invention, five plies are employed to form a business form assembly. The plies are superimposed one over the other with a first ply forming the top ply of the mailer, a second ply forming the back or front face of the return envelope, a third ply forming the other of the back or front face of the return envelope and a fourth ply forming the bottom of the mailer. A fifth ply is used as a fly sheet and normally overlies the first ply.

At least one and preferably a pair of margins are provided along opposite sides of the assembly with spaced feed holes such that the discrete plies can be mechanically fed to a manufacturing assembly station and printed with the pertinent information both on the fly sheet and on various ones of the mailer and return envelope. The margins are, of course, removed along a line of perforations connecting the margins to the edges of the mailer. Along a first edge of the mailer there is provided a line of perforations in each of the plies in registration one with the other defining a tear strip along a third and opposite edge of the second and third plies forming the return envelope there is similarly provided a line of weakening or perforations in registration one with the other. The second and third plies of the return envelope are secured one to the other by lines of adhesive along their the first, second and third edges. Two of the lines of adhesive lie parallel to one another in a direction of travel of the web through the manufacturing machine and extend from a second edge of the mailer (more specifically the return envelope), toward the fourth edge but terminate short of the fourth edge and short of a fold line in one of the second and third plies. The fold line extends between the first and third edges of the return envelope. The portion of the second or third ply between the fold line and the fourth edge defines both a return envelope flap and a record-keeping portion. A line of perforations along the other of the second and third plies and generally registering with the fold line, or between the fold line and the second edge of the mailer, defines with the fourth edge a record-keeping stub. This latter stub may be removed from the mailer when opened and placed in the return envelope along with other contents such as a check when the return envelope is used. The second and fourth edges of the second and third plies are inset from the second and fourth edges of the mailer such that the portions of the first and fourth plies along the second and fourth edges thereof may be adhesively secured one to the other with the second and third plies forming the return envelope therebetween.

Thus, it will be appreciated that the return envelope is smaller in height than the mailer, yet has sufficient height consistent with postal regulations. This enables the sheet of the mailer that is to form the back or the front of the return envelope to be large enough such that it can be used as the statement or stub for use as a return insert. The sheet of the return envelope may have a similar stub containing the same or different information and which may be retained for the user's records.

In a preferred embodiment according to the present invention, there is provided a multi-ply business form assembly including an integrated mailer and return envelope comprising generally rectilinear first, second, third and fourth plies in registration with one another, each ply having a first margin in registration with the first margins of others of the plies, the registering first margins having a plurality of registering spaced feed holes. Each of the plies has a line of marginal perforations extending adjacent the first registering margins and in registration with one another enabling removal of the registering first margins from the assembly to define a mailer having first, second, third and fourth generally orthogonally related edges, the first and third edges lying generally parallel to one another and the second and fourth edges lying generally parallel to one another. Each of the plies has a second line of perforations inset from and generally parallel to the marginal perforations, the second lines of perforations lying in registration with one another and defining a tear strip along the first edge of the mailer. Each of the second and third plies has a third line of perforations inset from the third edge of the mailer and generally parallel thereto, the third one of perforations in the second and third plies lying in registration one with the other and generally parallel to the second line of perforations, the first ply constituting a top ply of the mailer and having an address portion. The second ply constitutes one of a back or face sheet of the return envelope, the third ply constitutes another of the back or face sheet of the return envelope and the fourth ply constitutes a bottom ply of the mailer, with lines of adhesive between the second and third plies adjacent the first, second and third edges of the mailer, two of the lines of adhesive lying generally parallel to one another adjacent the first and third edges, respectively, and inset from the second and third lines of perforations, respectively. A fold line is provided along one of the second and third plies extending between the first and third edges of the mailer and spaced inwardly of the second and fourth edges of the mailer to define a return envelope flap between the fold line and the fourth edge, the parallel lines of adhesive extending from adjacent the second edge toward the fourth edge and terminating adjacent the fold line such that the second and third plies form the return envelope. An adhesive is carried by the flap for sealing the return envelope upon folding the flap over another of the second and third plies, another of the second and third plies including a line of weakening extending between the first and third edges and generally in registration with the fold line or spaced between the fold line and the second edge to define a removable record stub. Means are provided for securing the first and fourth plies to one another with the second and third plies therebetween.

In a preferred embodiment according to the present invention, there is provided a multi-ply business form assembly including an integrated mailer and return envelope comprising generally rectilinear first, second, third and fourth plies in registration with one another, each ply having a first margin in registration with the first margins of others of the plies, the registering first margins having a plurality of registering spaced feed holes. Each of the plies has a line of marginal perforations extending adjacent the first registering margins and in registration with one another enabling removal of the registering first margins from the assembly to define a mailer having first, second, third and fourth generally orthogonally related edges, the first and third edges lying generally parallel to one another and the second and fourth edges lying generally parallel to one another. Each of the plies has a second line of perforations generally parallel to the marginal perforations, the second lines of perforations lying in registration with one another and defining a tear strip along one of the first and third edges of the mailer. Each of the second and third plies has a third line of perforations inset from another of the first and third edges of the mailer and generally parallel thereto, the third line of perforations in the second and third plies lying in registration one with the other and generally parallel to the second line of perforations, the first ply constituting a top ply of the mailer and having an address portion. The second ply constitutes one of a back or face sheet of the return envelope, the third ply constitutes another of the back or face sheet of the return envelope and the fourth ply constitutes a bottom ply of the mailer, with means for securing the second and third plies one to the other adjacent the first, second and third edges of the mailer including two of the lines of adhesive lying generally parallel to one another adjacent the first and third edges, respectively, and inset from the second and third lines of perforations, respectively. A fold line is provided along one of the second and third plies extending between the first and third edges of the mailer and spaced inwardly of the second and fourth edges of the mailer to define a return envelope flap between the fold line and the fourth edge, the parallel lines of adhesive extending from adjacent the second edge toward the fourth edge and terminating adjacent the fold line such that the second and third plies form the return envelope. An adhesive is carried by the flap for sealing the return envelope upon folding the flap over another of the second and third plies, another of the second and third plies including a line of weakening extending between the first and third edges and generally in registration with the fold line or spaced between the fold line and the second edge to deflate a removable record stub. Means are provided for securing the first and fourth plies to one another with the second and third plies therebetween.

Accordingly, it is a primary object of the present invention to provide novel and improved business form assembly including a mailer and return envelope having a reduced number of plies.

BEST MODE FOR CARRYING OUT THE INVENTION

Reference will now be made in detail to a present preferred embodiment of the invention, an example of which is illustrated in the accompanying drawings.

Figure 1:
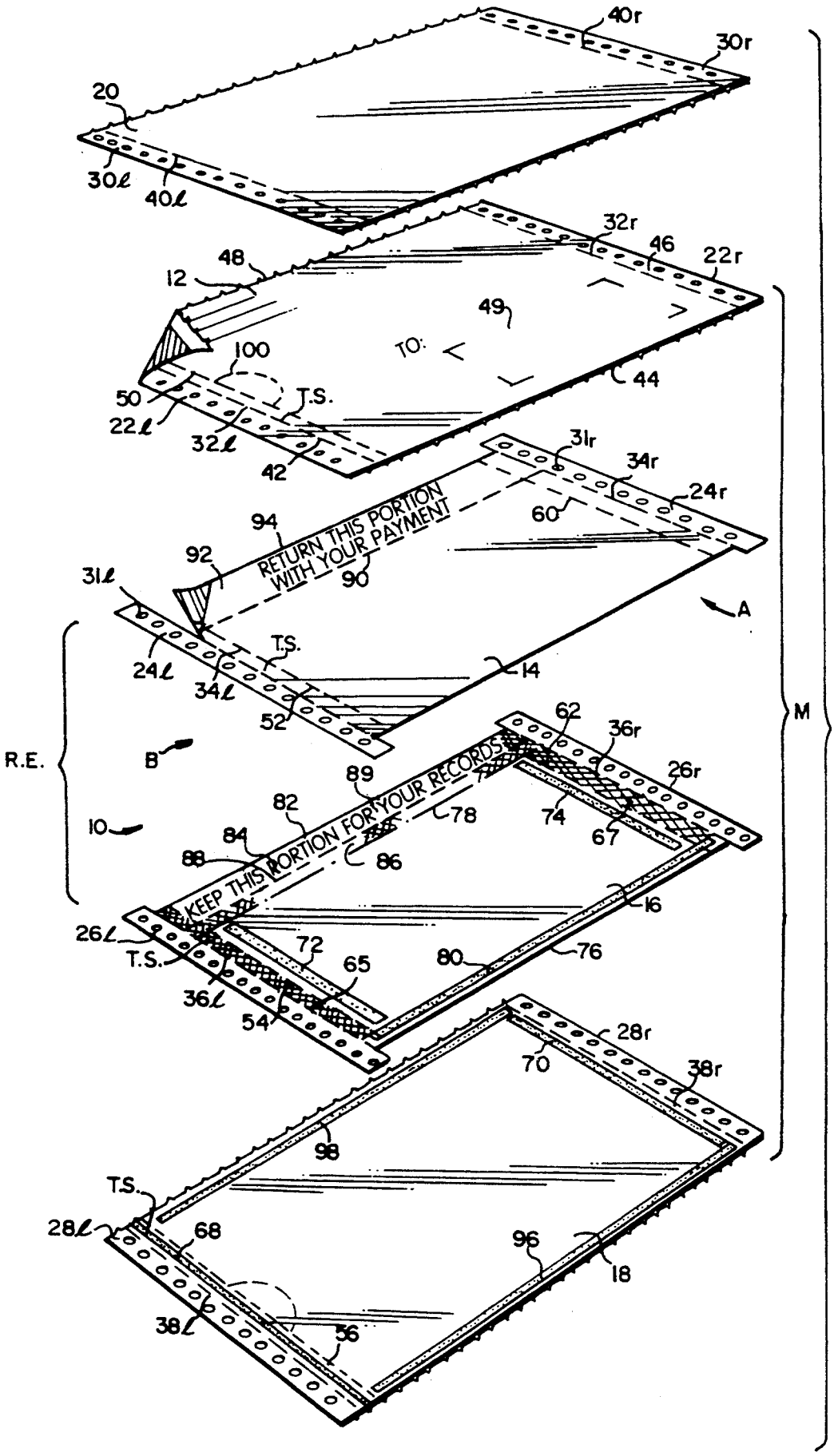
FIG. 1 is an exploded perspective view of a business form assembly constructed in accordance with the present invention as viewed from the top of assembly.
Figure 2:
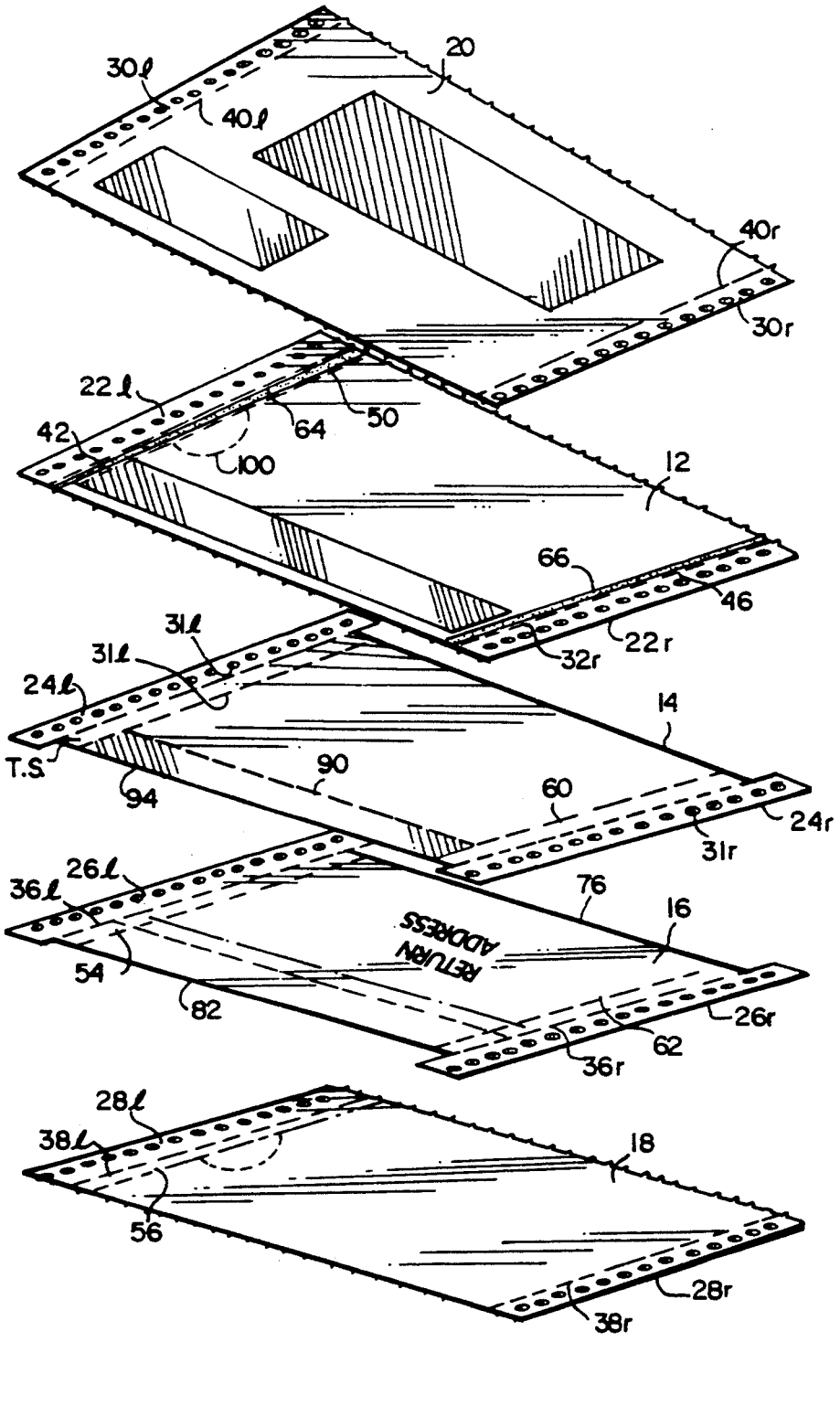
FIG. 2 is a view similarly to FIG. 1 as viewed from the bottom of the assembly.
Figure 3:
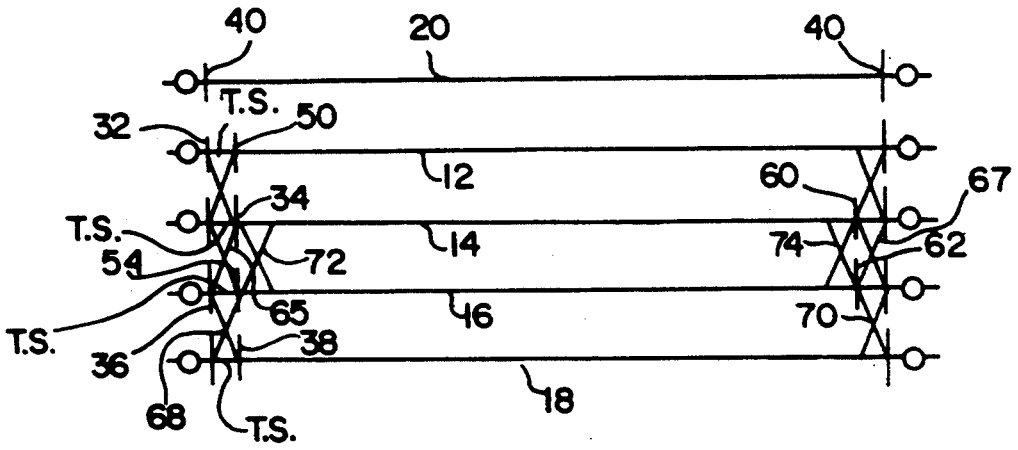
FIGS. 3 and 4 are schematic cross-sectional views of the assembly of FIG. 1 looking generally in the direction of the arrows denoted A and B respectively.
Figure 4:
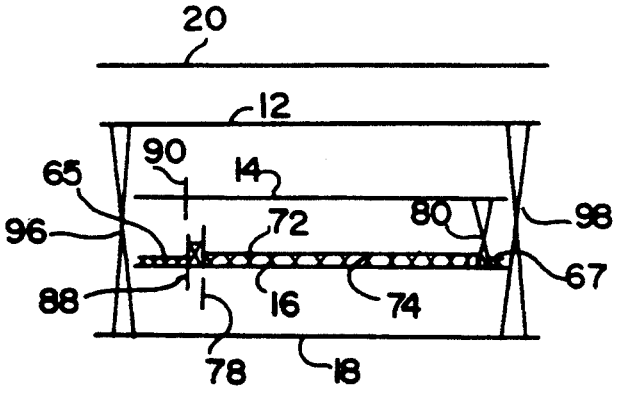

Referring to the drawings, particularly to FIGS. 1 and 2, there is illustrated a business form assembly constructed in accordance with the present invention and generally designated 10. Business form assembly 10 includes a first ply 12, a second ply 14, a third ply 16 and a fourth ply 18. A fifth ply 20 serves as a fly sheet as described hereinafter. The plies are generally rectilinear and lie in registration with one another. Each of the plies has first and second linearly extending generally parallel margins along opposite side edges of the assembly 10 namely margins 22, 24, 26, 28 and 30 of the first through fifth plies, respectively. The suffices "l" and "r" are used variously throughout this description to denote left and right sides of the assembly where the part designated by the numeral preceding the suffix identifies a like part on opposite sides of the assembly. Each margin includes a plurality of longitudinally spaced feed holes 31 whereby the webs forming the plies may be mechanically transported by infeeders. The margins register one with the other along opposite edges of the business form assembly as does a line of marginal perforations 32, 34, 36, 38 and 40 in the first through fifth plies respectively. The lines of perforations register one with the other and define the margins enabling their joint removal from the opposite sides of the assembly to define a mailer M having first, second, third and fourth orthogonally related edges 42, 44, 46 and 48, respectively. The first ply 12 of the mailer includes an address portion 49.

A tear strip T.S. is formed along a first edge 42 of the mailer. Particularly, a second line of perforations 50, 52, 54 and 56 lying in registry one with the other in the mailer and with the left margins defines a tear strip T.S. in each of the plies.

It will be appreciated that the first and fourth plies 12 and 18 form the top and bottom sheets of mailer M while the second and third plies 14 and 16, respectively, form the return envelope R.E. Also, each of the second and third plies 14 and 16 has a third line of perforations 60 and 62, respectively, generally parallel to the first and third edges 42 and 46 of mailer M and which third lines of perforation lie in registry with one another.

To secure the various plies to one another to form business form assembly 10, lines of adhesive are applied between the first through fourth plies as will now be described, it being understood that the phrase "lines of adhesive" can mean a continuous strip of adhesive or discontinuous strip, for example, in the form of dots or segments of adhesive. To secure the first ply 12 to the second ply 14 along first edge 42 of mailer M, a line of adhesive 64 is (FIG. 2) disposed between the registering tear strips T.S. To secure the third edges of the first and second plies to one another, a line of adhesive 66 is applied between an edge portion of the first ply 12 inset from the line of perforations 32*r* and between the line of perforations 34r and a line of perforations 60 in the second ply 14. These lines of adhesive may, for example, be comprised of deactivated adhesive applied along the underside of the first ply 12 as illustrated in FIG. 2.

To secure the second and third plies 14 and 16 one to the other to form a portion of the mailer, lines of adhesive 65 and 67 are disposed between the first and third edges thereof inwardly of the perforation lines 36*l* and 36*r* and outwardly of the perforation lines 54 and 62, respectively. These lines of adhesive 65 and 67 extend between and to the second and fourth edges.

To secure the third and fourth plies 16 and 18 one to the other, lines of adhesive are disposed between the first and third edges of the third and fourth plies. Thus, a first line of adhesive 68 is preferably applied along the upper side of tear strip T.S. on the fourth ply 18 for adhesive securement to the underside of the tear strip T.S. of the third ply adjacent the first edge 42 of mailer M. At the third edge 46 of the mailer, a line of adhesive 70 may likewise be applied along the upper surface of fourth ply 18 inset from the line of perforations 38*r* for adhesive attachment to the underside of the third ply between the lines of perforations 36*r* and 62.

To secure the second and third plies 14 and 16 one to the other to form the return envelope R.E. of the mailer, two parallel lines of adhesive are preferably disposed along the third ply 16 inset from the lines of perforations 54 and 62 respectively, the lines of adhesive extending from the second edge 76 of the return envelope to a fold line 78. Fold line 78 extends between lines of perforations 54 and 62 and is inset from parallel to the edge 82 of the return envelope. Thus, if the third ply 16 comprises the front face of the return envelope, the front face is secured to the back face of the second ply by the parallel lines of adhesive 72 and 74 and a third line of adhesive 80 extending along the second edge 76 of the return envelope.

As will be seen from FIG. 1, the portion of the third ply 16 between fold lines 78 and the fourth edge 82 of the return envelope forms a flap 84. In this illustrated embodiment, a portion of flap 84 has a line of rewettable adhesive 86 defined between fold line 78 and a line of perforations 88. The portion of the flap 84 between perforation line 88 and edge 82 forms a detachable record-keeping stub 89. Also, the second ply 14, e.g., forming the backside of the return envelope, has a line of perforations 90 extending between the first and third edges 42 and 46, respectively, of the mailer. The line of perforations 90 generally overlie the fold line 78. Alternatively, line of perforations 90 may be spaced from fold line 78 inwardly toward the second edge 76. The portion 92 of the second ply 14 between perforation line 90 and fourth edge 94 of the return envelope may constitute a detachable record-keeping stub similarly as the portion 89 of the third ply. Thus, computer-generated information may be printed on these record-keeping stubs 92 and 89.

To secure the mailer in final assembly, lines of adhesive are provided along the second and fourth edges 44 and 48 of the mailer respectively. For example, lines of adhesive 96 and 98 may be provided along the second and fourth edges joining the marginal portions of the first and fourth plies which lie in registry one with the other. It will be appreciated that the second and fourth edges of the second and third plies are inset as illustrated from the edges of the mailer to enable direct adhesive contact between marginal portions of the second and fourth edges 44 and 48, respectively, along the first and fourth plies.

Flyer sheet 20, i.e., fifth ply, is mechanically connected to mailer M along the margins 30. Other mechanical means may be employed to connect the fly sheet 20 to the other plies.

In use, the assembly is printed with computer generated information and, through use of carbonless paper, various portions of the assembly can be printed, e.g., with computer-generated information, namely the return stub 92, the record-keeping portion 89 and addressing information on the first ply 12. After printing occurs, the fly sheet and the margins are removed leaving the mailer M. Upon receiving the mailer, the recipient tears along the aligned perforations 50, 52, 54 and 56 to remove the tear strips T.S. A thumbnail perforation 100 is provided in each of the first and fourth plies such that the recipient can grasp the contents of the mailer, i.e. the return envelope formed by the second and third plies 14 and 16, respectively. By grasping the opposite end of the mailer, the return envelope can be removed along the aligned perforations 60 and 62. The recipient then detaches the stub 92 by tearing along perforation line 90 and the record portion 89 by tearing along perforation line 88. The recipient may then complete the return portion as needed and enclose the return portion and other materials such as a check, in the return envelope, with the return stub 92. The record-keeping portion 89 may be retained by the recipient. The rewettable adhesive 86 is then wetted and the flap folded along fold line 78 over the edge of second ply 14 to seal the return envelope. Consequently, it will be appreciated that only a five part business form assembly is provided with the necessary record-keeping portions being formed integrally with the front or back faces of the return envelope.

Figure 5:
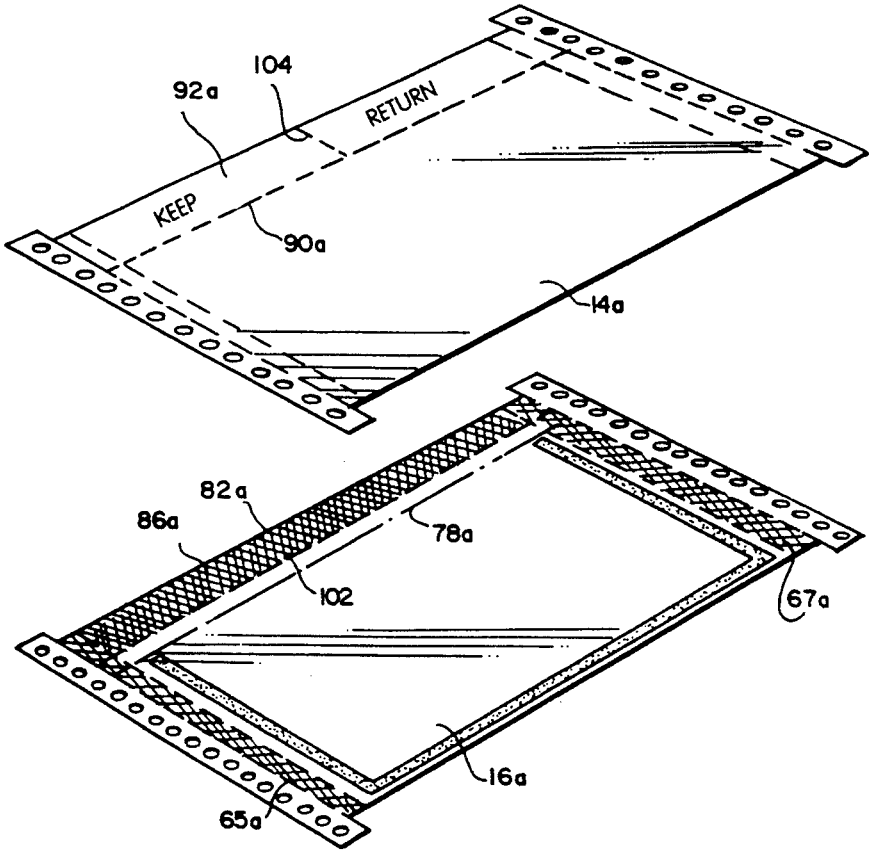
FIGS. 5, 6 and 7 are views similar to FIG. 1 but illustrating only the second and third plies of the mailer in different embodiments thereof.

Referring now to the embodiment hereof illustrated in FIG. 5, wherein like reference numerals apply to like parts followed by the letter suffix "a", only the second and third plies 14a and 16*a* of the business form assembly are illustrated, the fourth and fifth plies being identical to those previously described. In this form, however, the rewettable adhesive 86*a* is disposed between the edge 82*a* of the return envelope and a line of perforations 102 spaced outwardly from fold line 78*a*. Thus, there is no record-keeping stub on third ply 16*a* and the entirety of the ply is used as the front face of the return envelope and its flap. The second ply 14*a*, however, has a record-keeping portion 92*a* which is divided by a perforation line 104 into portions which the recipient may keep for his own records and forward in the return envelope, respectively. Thus, when the recipient has opened the mailer and removed the return envelope as previously described, the record-keeping portion may be detached along perforation line 90*a* and separated along perforation line 104 into record-keeping and return stubs. The return stub may be inserted into the return envelope along with other materials and the flap closed with the adhesive 86*a* sealing the return envelope.

Figure 6:
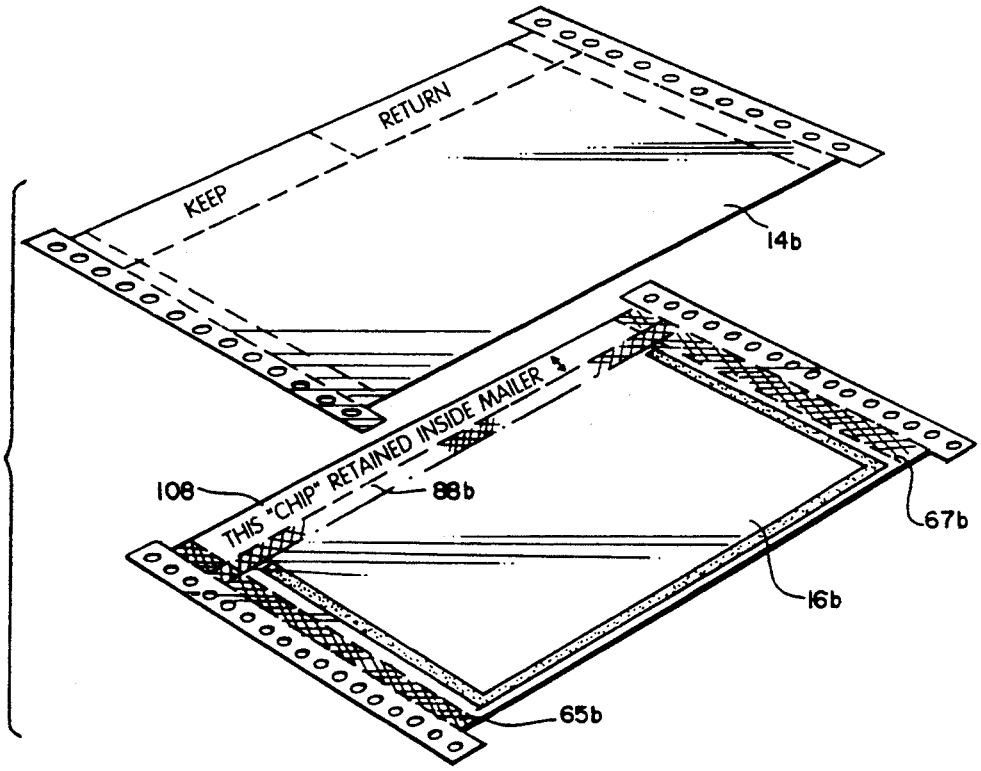

In the embodiment hereof illustrated in FIG. 6, the second ply 14*b* is identical to the second ply 14*a* illustrated in the previous embodiment of FIG. 5. In this form, however, the third ply 16*b* has a very weak line of perforations 88*b* with the remaining outside portion 108 of the third ply being retained within the mailer when the return envelope is removed.

Figure 7:
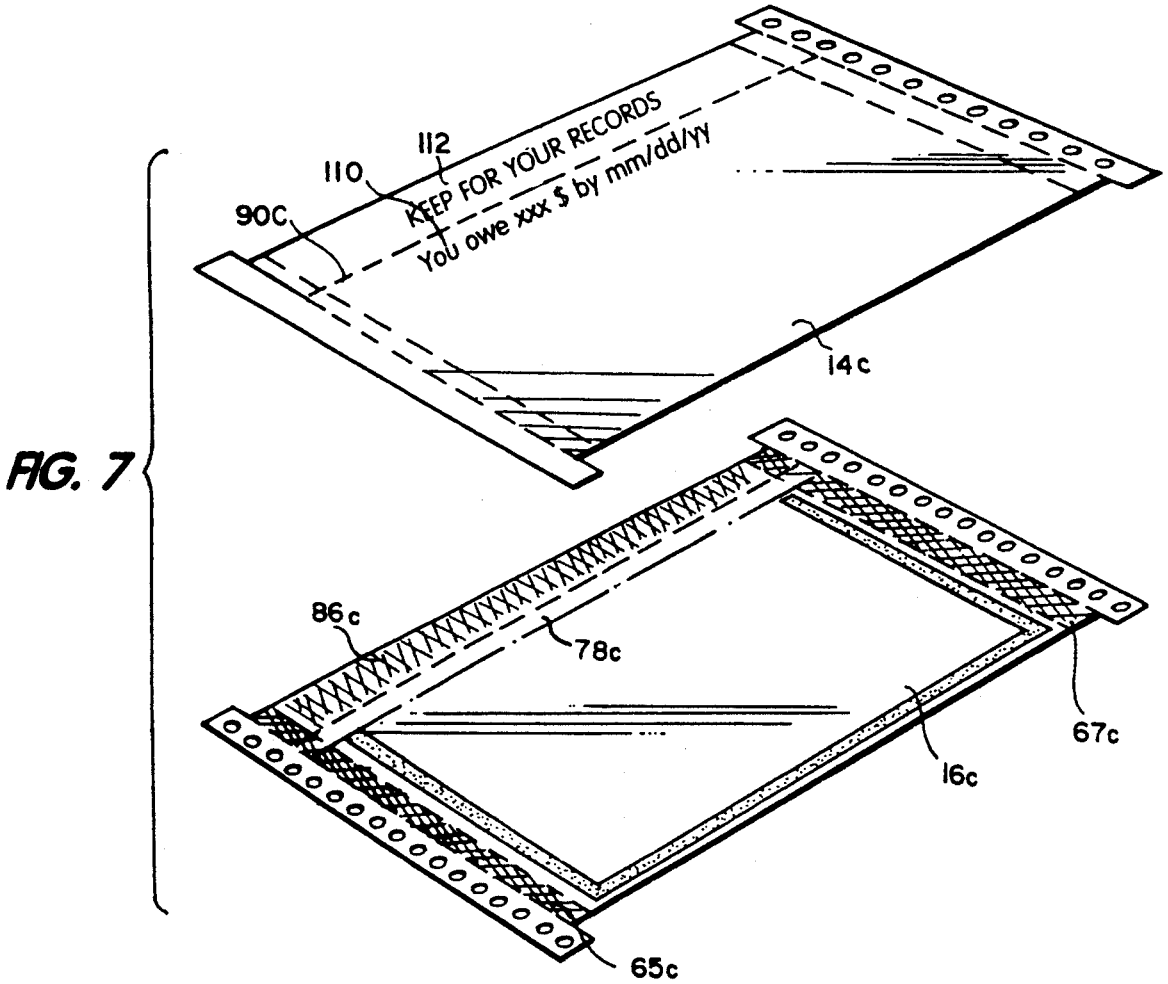

In the embodiment illustrated in FIG. 7, the second ply 14*c* has a printed area or portion 110 inset from the line of perforations 90c. The portion 112 of the second ply 14c outboard of perforations 90*c* may be torn from the second ply along the line of perforations 90c for record-keeping purposes. Instead of a return stub for insertion into the envelope, the printing in area 110 constitutes the preprinted information useful to the receiver of the return envelope, for example, to accurately credit the account of the original addressee.

The third ply 16c has a line of rewettable adhesive 86*c* disposed adjacent the outer or fourth edge of the return envelope with a space between the adhesive and the fold line 78*c*. Consequently, the recipient of the mailer may place his own original materials in the envelope, for example, a check, and fold over the flap to close the return envelope. The adhesive 86*c* secures to the outer face of the return envelope below the printed area 110. In this manner, the recipient of the return envelope can open the return envelope and quickly review the information preprinted on portion 110 and compare it with the enclosed materials. That is, instead of using a return stub with preprinted information, the return envelope itself may be preprinted with necessary information. There is no need for a return stub per se.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A multi-ply business form assembly including an integrated mailer and return envelope comprising:

generally rectilinear first, second, third and fourth plies in registration with one another, each ply having a first margin in registration with the first margins of others of said plies, said registering first margins having a plurality of registering spaced feed holes;

each of said plies having a line of marginal perforations extending adjacent the first registering margins and in registration with one another enabling removal of the registering first margins from the assembly to define a mailer having first, second, third and fourth generally orthogonally related edges, said first and third edges lying generally parallel to one another and said second and fourth edges lying generally parallel to one another;

each of said plies having a second line of perforations inset from and generally parallel to said marginal perforations, said second lines of perforations lying in registration with one another and defining a tear strip along said first edge of said mailer;

each said second and third plies having a third line of perforations inset from said third edge of said mailer and generally parallel thereto, said third line of perforations in said second and third plies lying in registration one with the other and generally parallel to said second line of perforations;

said first ply constituting a top ply of the mailer and having an address portion;

said second ply constituting one of a back or face sheet of the return envelope;

said third ply constituting another of said back or face sheet of the return envelope;

said fourth ply constituting a bottom ply of the mailer;

lines of adhesive between said second and third plies adjacent said first, second and third edges of said mailer, two of said lines of adhesive lying generally parallel to one another adjacent said first and third edges, respectively, and inset from said second and third lines of perforations, respectively;

a fold line along one of said second and third plies extending between said first and third edges of said mailer and spaced inwardly of said second and fourth edges of said mailer to define a return envelope flap between said fold line and said fourth edge, said parallel lines of adhesive extending from adjacent said second edge toward said fourth edge and terminating adjacent said fold line such that said second and third plies form the return envelope;

an adhesive carried by said flap for sealing said return envelope upon folding said flap over another of said second and third plies, said another of said second and third plies including a line of weakening extending between said first and third edges and generally in registration with said fold line or spaced between said fold line and said second edge to define a removable record stub; and means for securing said first and fourth plies directly to one another with the second and third plies therebetween.

2. A business form assembly according to claim 1 wherein said second and third plies have second and fourth edges inset from the second and fourth edges of the mailer, respectively, to define edge portions of said first and fourth plies along each of the second and fourth edges of the mailer in direct registration with one another without portions of said second and third plies intervening therebetween, and lines of adhesive between said registering edge portions to secure said first and fourth plies to one another.

3. A business form assembly according to claim 1 wherein said flap sealing adhesive is spaced inwardly of the fourth edge of said another of said second and third plies, said assembly further including a line of perforations between said flap sealing adhesive and said fourth edge of said one of said second and third plies to define a second record stub.

4. A business form assembly according to claim 1 wherein said flap sealing adhesive is spaced outwardly of said fold line and extends to said fourth edge of said one of said second and third plies.

5. A business form assembly according to claim 1 including a line of perforations extending between said first and third edges of said mailer and between said fold line and said fourth edge of said one of said second and third plies.

6. A business form assembly according to claim 1 including a printed portion on said one of said second and third plies adjacent said fold line, said flap sealing adhesive being spaced outwardly of said fold line and extending to said fourth edge of said one of said second and third plies to define a flap portion sized to span across said printed portion when said flap is folded over to seal the return envelope.

7. A business form assembly according to claim 1 wherein each of said plies has a second linearly extending margin in registration with the second margin of others of said plies, said registering second margins having a plurality of registering spaced feed holes, each of said plies having a second line of marginal perforations extending adjacent the second registering margins and in registration with one another enabling removal of the registering second margins from the assembly.

8. A business form assembly according to claim 1 including a fifth ply in registration with said first, second, third and fourth plies and including a first linearly extending margin in registration with the first margins of others of said plies and having a plurality of spaced feed holes, a first line of marginal perforations on said fifth ply extending adjacent the first registering margins and in registration therewith enabling removal of the registering first margins from the assembly.

9. A multi-ply business form assembly including an integrated mailer and return envelope comprising:

generally rectilinear first, second, third and fourth plies in registration with ,one another, each ply having a first margin in registration with the first margins of others of said plies, said registering first margins having a plurality of registering spaced feed holes;

each of said plies having a line of marginal perforations extending adjacent the first registering margins and in registration with one another enabling removal of the registering first margins from the assembly to define a mailer having first, second, third and fourth generally orthogonally related edges, said first and third edges lying generally parallel to one another and said second and fourth edges lying generally parallel to one another;

each of said plies having a second line of perforations generally parallel to said marginal perforations, said second lines of perforations lying in registration with one another and defining a tear strip along one of said first and third edges of said mailer;

each said second and third plies having a third line of perforations inset from another of said first and third edges of said mailer and generally parallel thereto, said third line of perforations in said second and third plies lying in registration one with the other and generally parallel to said second line of perforations;

said first ply constituting a top ply of the mailer and having an address portion;

said second ply constituting one of a back or face sheet of the return envelope;

said third ply constituting another of said back or face sheet of the return envelope;

said fourth ply constituting a bottom ply of the mailer;

means for securing said second and third plies one to the other adjacent said first, second and third edges of said mailer including two of said lines of adhesive lying generally parallel to one another adjacent said first and third edges, respectively, and inset from said second and third lines of perforations, respectively;

a fold line along one of said second and third plies extending between said first and third edges of said mailer and spaced inwardly of said second and fourth edges of said mailer to define a return envelope flap between said fold line and said fourth edge, said parallel lines of adhesive extending from adjacent said second edge toward said fourth edge and terminating adjacent said fold line such that said second and third plies form the return envelope;

an adhesive carried by said flap for sealing said return envelope upon folding said flap over another of said second and third plies, said another of said second and third plies including a line of weakening extending between said first and third edges and generally in registration with said fold line or spaced between said fold line and said second edge to define a removable record stub; and means for securing said first and fourth plies directly to one another with the second and third plies therebetween.

10. A business form assembly according to claim 9 wherein said second and third plies have second and fourth edges inset from the second and fourth edges of the mailer, respectively, to define edge portions of said first and fourth plies along each of the second and fourth edges of the mailer in direct registration with one another without portions of said second and third plies intervening therebetween, and lines of adhesive between said registering edge portions to secure said first and fourth plies to one another.

11. A business form assembly according to claim 9 wherein said flap sealing adhesive is spaced inwardly of the fourth edge of said another of said second and third plies, said assembly further including a line of perforations between said flap sealing adhesive and said fourth edge of said one of said second and third plies to define a second record stub.

12. A business form assembly according to claim 9 wherein said flap sealing adhesive is spaced outwardly of said fold line and extends to said fourth edge of said one of said second and third plies.

13. A business form assembly according to claim 9 including a line of perforations extending between said first and third edges of said mailer and between said fold line and said fourth edge of said one of said second and third plies.

14. A business form assembly according to claim 9 including a printed portion on said one of said second and third plies adjacent said fold line, said flap sealing adhesive being spaced outwardly of said fold line and extending to said fourth edge of said one of said second and third plies to define a flap portion sized to span across said printed portion when said flap is folded over to seal the return envelope.

15. A business form assembly according to claim 9 wherein each of said plies has a second linearly extending margin in registration with the second margin of others of said plies, said registering second margins having a plurality of registering spaced feed holes, each of said plies having a second line of marginal perforations extending adjacent the second registering margins and in registration with one another enabling removal of the registering second margins from the assembly.

16. A business form assembly according to claim 9 including a fifth ply in registration with said first, second, third and fourth plies and including a first linearly extending margin in registration with the first margins of others of said plies and having a plurality of spaced feed holes, a first line of marginal perforations on said fifth ply extending adjacent the first registering margins and in registration therewith enabling removal of the registering first margins from the assembly.

* * * * *